United States Patent [19]

Riedle et al.

[11] Patent Number: 4,898,246

[45] Date of Patent: Feb. 6, 1990

[54] QUICK RELEASE VALVE FOR SPRINKLER HEAD

[75] Inventors: Armin Riedle, Rathingen; Horst Zientek, Kaarst, both of Fed. Rep. of Germany

[73] Assignee: Total Walther Feuerschutz GmbH, Fed. Rep. of Germany

[21] Appl. No.: 206,029

[22] Filed: Jun. 13, 1988

[30] Foreign Application Priority Data

| | | | |
|---|---|---|---|
| Jul. 6, 1987 | [DE] | Fed. Rep. of Germany | 3722233 |
| Jul. 22, 1987 | [DE] | Fed. Rep. of Germany | 3724215 |
| Aug. 6, 1987 | [DE] | Fed. Rep. of Germany | 3726120 |

[51] Int. Cl.[4] ..... A62C 37/14; A62C 37/10; A62C 37/08

[52] U.S. Cl. ..... 169/38; 169/41

[58] Field of Search ..... 169/42, 37, 38, 39, 169/41, 90

[56] References Cited

U.S. PATENT DOCUMENTS

| | | | |
|---|---|---|---|
| H121 | 9/1986 | Pieczykolan | 169/37 |
| 1,905,676 | 4/1933 | Barclay | 169/38 |
| 4,109,727 | 8/1978 | Job | 169/41 |
| 4,217,961 | 8/1980 | Wotton | 169/41 |
| 4,739,835 | 4/1988 | Polan et al. | 169/38 |
| 4,796,710 | 1/1989 | Job | 169/37 X |
| 4,830,115 | 5/1989 | Polan | 169/90 |

FOREIGN PATENT DOCUMENTS

| | | | |
|---|---|---|---|
| 333412 | 8/1930 | United Kingdom | 169/38 |
| 2188841 | 10/1987 | United Kingdom | 169/38 |
| 2206043 | 12/1988 | United Kingdom | 169/38 |
| 2206489 | 1/1989 | United Kingdom | 169/37 |

*Primary Examiner*—Joseph F. Peters, Jr.
*Assistant Examiner*—James M. Kannofsky
*Attorney, Agent, or Firm*—Horst M. Kasper

[57] ABSTRACT

The invention relates to a release element for sprinkler systems comprising a cylindrical tube, where the ends of the cylindrical tube are respectively hermetically sealed by melting to a plug, where provisions are disposed jointly with the closure piece and counter piece of the sprinkler, which only exert pressure forces onto the center cylinder-shaped tube portion of the release element.

16 Claims, 6 Drawing Sheets

QUICK RELEASE VALVE FOR SPRINKLER HEAD

BACKGROUND OF THE INVENTION

1. Field of the Invention

The invention relates to a release element for a thermal and/or electrical release of a fire-protection system, in particular a sprinkler system, where the release element formed from glass is filled up to bursting with a liquid.

2. Brief Description of the Background of the Invention Including Prior Art

Such release elements keep the valves in sprinkler heads closed and are to be destroyed by expansion of the bursting liquid in case of a fire. The release elements have to perform two functions. On the one hand, they have to receive the compression forces in order to keep the valve constantly in a closed state if there is no fire and, on the other hand, they have to burst quickly in case of a fire, such that the extinguishing process is initiated quickly. In addition, the sprinker heads have to remain in a functioning state over decades.

In order to combine the two functions in an optimum manner, a number of release elements are known. For example, the increase of the compression forces by a different forming of the glass release elements has been attempted to be achieved in the U.S. Pat. No. 1,733,701 without extending the bursting time. It is further known to decrease the bursting time by inserting a displacement body inside of the bursting liquid (German Patent Application Laid Open DE-OS No. 3,220,124).

SUMMARY OF THE INVENTION

1. Purposes of the Invention

It is an object of the invention to provide a release element which can be produced with simple means and without large expenditures.

It is another object not to impair the requirements for sufficient stability during tensioning and for quick bursting times in case of fire.

These and other objects and advantages of the present invention will become evident from the description which follows.

2. Brief Description of the Invention

The present invention provides for a release element formed from glass for release of a fire-protection system, in particular a sprinkler system. The release element comprises a cylindrical glass tube with a thin wall thickness. An upper glass plug closes the cylindrical glass tube at its upper end. A lower glass plug is disposed and attached at the lower end of the cylindrical glass tube. A filler opening is disposed in the lower glass plug. A bursting liquid is filled into the lower glass plug to provide bursting of the release element with said liquid under specified conditions. The filler opening is hermetically closed by melting in its lower part after the filling in of the bursting liquid.

The upper glass plug and the lower glass plug can be tapered in axial direction.

The release element can be pressed against a closure piece by a counter piece in a sprinkler. The sprinkler can be provided with a sprinkler casing and with a sprinkler bow. The upper glass plug and the lower glass plug can be respectively provided with a planar face running respectively at a right angle relative to a center axis of the glass tube. The lower planar face can rest at a planar face of the closure piece of the sprinker casing, and the upper planar face can rest at a planar face of the counter piece of the sprinkler bow.

The closure piece and the counter piece can be respectively provided with a collar. The inner faces of the collar can run parallel to the center axis of the glass tube. The outer faces of the respective plugs can rest planarly at the collar inner faces.

A curvature can be respectively provided between the outer faces and the planar faces of the release element.

One of the plugs can be provided on the outer side with a tension element, which tension element solidly spans around the plug. The tension element can be formed as a closed cap member, which cap member can be led into the region of the cylindrical tube. The cap member can be solidly connected with an elastic mass to a respective plug.

The fire protection system can be electrically released and a sprinkler system can be thermally released. The cap member can be made of a non-iron metal, such as aluminum, brass, or the like.

The counter piece and/or the closure piece can be formed as tension elements and the counter piece and/or the closure piece can solidly surround the release element with a collar. The collars can be extended up to the region of the cylindrical tube.

The plugs can be covered on their outer face with an elastic mass and can rest on the elastic mass.

The tension element can be formed as a rotating tension band which can be solidly clamped under tension in a groove of the plug. The tension band can be formed by an O-ring which can be comprised of a copper wire.

The inner space of the release element can exhibit at the upper end a semi-spherical shape and at the lower end a funnel shape.

According to the invention, the release element comprises a cylindrical glass tube having a thin wall thickness, which is closed at its upper end with a glass plug and which is provided at its lower end with a plug with a filler opening which is hermetically sealed by melting after the filling in of the bursting liquid or fluid in the lower part.

The release element can be manufactured from an easily produceable cylindrical tube, where the length is somewhat larger than the required shaft height for forming of the space for receiving the bursting liquid. The protruding ends of the glass tube can be melted to a plug without difficulties. Thus, the plugs are formed with respect to their length and strength such that the axial comprssion forces are transferred to the thin wall of the cylindrical tube piece in an optimum manner.

A cylindrical glass tube is a tube having circular cross-sections and a continuous line of center points of the circular cross-sections. A plug is a piece of glass disposed at the end of a glass tube for sealing the tube or for providing a defined port, which can be sealed by melting the glass in the port area.

Cylindrical glass tubes with melted on plugs for stabilization are known from neon tubes, such as taught in German Patent DE-PS No. 2,930,249. These glass tubes are however not filled with a bursting liquid but with an inert gas which is not provided to induce bursting of the glass body. In order to improve the fatigue limit of the release element upon axial loading, it is further disclosed that the plugs are respectively provided with a planar face running at a right angle to the center axis, where the lower planar face rests flat at a planar face of a closure piece of the sprinkler casing and where the upper planar face rests flat at a planar face of a counter piece of the sprinkler wing.

In this manner it is achieved that the cylindrical shaft portion of the release element with the thin wall face is only impinged by pressure forces such that this sensitive portion remains free from all bending and shearing tensions.

In order to improve the application of the axial forces to the center cylindrical portion of the release element, it is further disclosed that the closure piece and the counter piece are respectively provided with a collar, where the inner faces of the collar run parallel to the center axis such that the outer faces of the plugs can rest thereon in a planar fashion.

In order that the transition locations do not experience increased tensions between the cylindrical outer faces of the plugs and the planar faces running thereto at a right angle, it is disclosed that at these locations a curvature is provided in each case. A further improvement of the fatigue limit of the release element upon axial loading is achieved by providing the plugs on the outer face respectively with a tension element, which solidly span around the plug.

By the use of tension elements it is achieved that the plugs can absorb shearing forces without damage to the release element and the cylindrical shaft part of the release elements with the thin wall face is thus only impinged by pressure forces such that this sensitive part remains free of any bending or shearing tensions.

In order to improve the application of the axial forces onto the center cylindrical part of the release element, it is furthermore disclosed that the tension elements are provided as closed caps and/or cap rings, which are led up to the region of the cylindrical tube, whereby the caps or cap rings can be solidly connected with the plugs by way of an elastic mass.

The novel features which are considered as characteristics for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
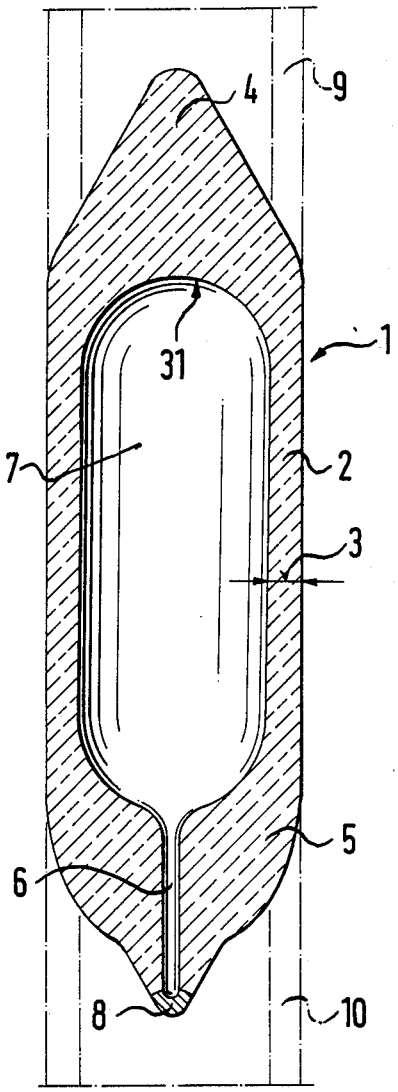
FIG. 1 is a cross-sectional view of a release element.

In accordance with the present invention, there is provided a release element for thermal and/or electrical release of a fire-protection system, in particular a sprinkler system. The release element, formed from glass, is filled to its bursting with a liquid. The release element 1 comprises a cylindrical glass tube 2 with a thin wall thickness 3. The glass tube 2 is closed at its upper end by means of a glass plug 4 and is provided at its lower end with a plug 5 and a filler opening 6. The lower part 8 of the glass tube 2 is hermetically closed by melting after the filling of the bursting liquid into the inner chamber 7.

The plugs 4, 5 an be tapering in axial direction. The release element 1 can be pressed against a closure piece 14 by a counter piece 15 in a sprinkler 11. The plugs 4, 5 can be respectively provided with a planar face 17, 18 running respectively at a right angle relative to the center axis 39. The lower planar face 18 can rest at a planar face 23 of the closure piece 14 of the sprinkler casing 12. The upper planar face 17 can rest at a planar face 24 of the counter piece 15 of the sprinkler bow 13. The closure piece 14 and the counter piece 15 can be respectively provided with a collar 25, 26. The inner faces 27, 28 of the collar can run parallel to the center axis 39. The outer faces 19, 20 of the plugs 4, 5 can rest planarly at the collar inner faces 27, 28. A curvature 21, 22 can be provided respectively between the outer faces 19, 20 and the planar faces 17, 18 of the release element 1. The plugs 4, 5 can be respectively provided on the outer side with a tension element which can solidly span around the plugs. The tension elements can be formed as closed caps 33 and/or cap rings 34, which are led into the region of the cylindrical tube projection 10. The caps 33 or the cap rings 34 can be solidly connected with an elastic mass 35, 36 to the plugs 4, 5. The caps 33 and the cap rings 34 can be made of a non-iron metal, such as aluminum, brass, or the like.

The plugs 4, 5 can be respectively provided on the outer side with a tension element which can solidly span around the plugs. The counter piece 15 and/or the closure piece 14 can be formed as tension elements and can solidly surround the release element 1 with a collar 25. The coollars 25, 26 can extend up to the region of the cylindrical tube projection 10. The plugs 4, 5 can be covered on their outer face with an elastic mass 35, 36 on which the pieces 4, 5 can rest. The tension element can be formed as a rotating tension band 37 which can be solidly clamped under tension in a groove 38 of the plug 4, 5. The tension band 37 can be formed by an O-ring comprised of a copper wire. The inner space 7 of the release element 1 can exhibit at the upper end a semi-spherical shape 31 and at the lower end a funnel shape 32.

The release element 1 is formed from a cylindrical glass tube 2 having a thin wall thickness 3. The end projections 9 and 10 of the glass tube 2 are melted down to plugs 4 and 5. The plug 5 is provided with a filler opening 6, which is hermetically sealed at the end 8 by melting after the filling in of the busting liquid into the inner space 7.

Figure 2:
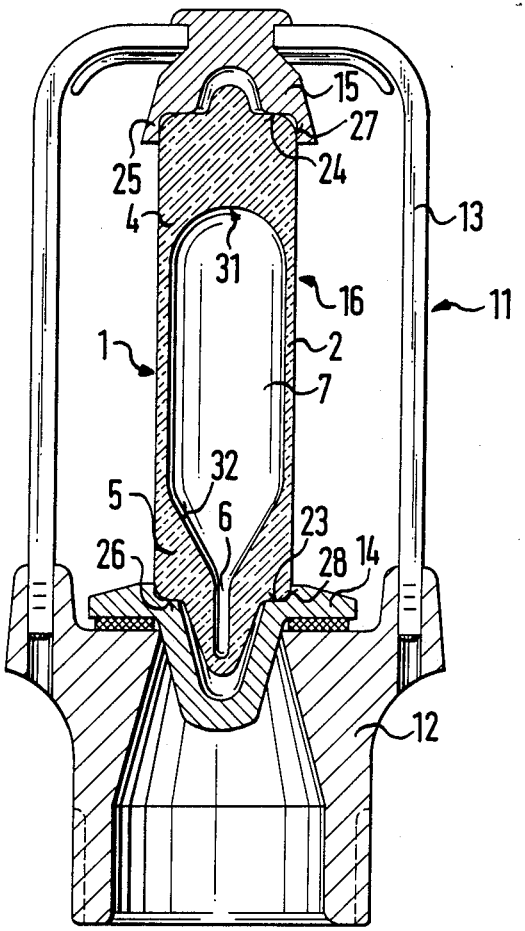
FIG. 2 is a cross-sectional view of a sprinkler with the release element.

FIG. 2 illustrates a sprinkler 11 with a sprinkler casing 12 and a sprinkler bow 13 with a spray dish, not designated in detail. The sprinkler 11 is closed by the release element 1 and a closure piece 14, where the release element 1 rests at the other end against a counter piece 15. Based on provisions, not illustrated, the release element 1 is kept under pressure such that the closure piece 14 rests sealingly on the sprinkler casing.

The release element 1 comprises a center cylindrical tube part 16 with a thin wall thickness and two plugs 4 and 5, where the lower plug 5 is provided with a filler opening 6, which was closed at the end 8 after the filling in of the bursting liquid into the inner space 7. At the upper end, the inner space 7 is formed like a semisphere 31 and, at the lower end, the inner space 7 is formed like a funnel 32.

In order for the closing forces acting on the release element 1 to exert only axial pressure forces onto the center cylindrical tube piece 16, there are provided planar faces 17 and 18 in the region of the plugs 4 and 5, which planar faces 17 and 18 run at a right angle to the center axis 39 of the release element 1. Curvatures 21 and 22 are provided between these planar faces 17 and 18 and the cylindrical outer faces 19 and 20 of the plugs 4 and 5. The release element 1 rests with its planar face 18 on a planar face 23 of the closure piece 14. The planar face 17 rests against a planar face 24 of the counter piece 15. In order to avoid bending and shearing forces, the closure piece 14 and the counter piece 15 are respectively provided with a collar 25 and 26, which collars exhibit inner planar faces 27 and 28 running parallel to the center axis 39 of the release element 1 such that the cylindrical outer faces 19 and 20 of the plugs 4 and 5 rest flatly at the inner faces of the collars 25 and 26.

Figure 4:
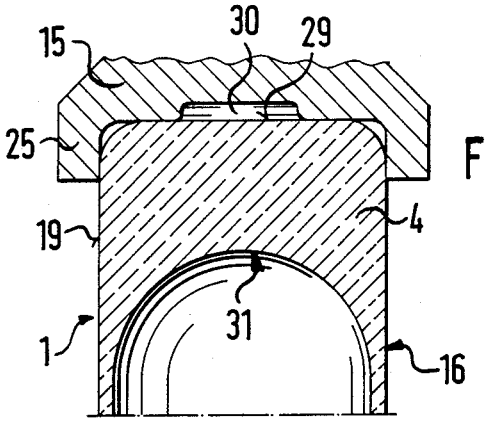
FIG. 4 is a sectional view of a further embodiment of the upper part of the release element.
Figure 3:
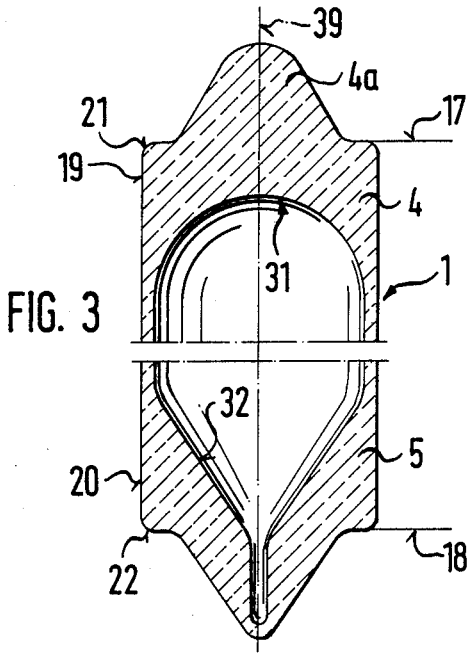
FIG. 3 is an enlarged sectional illustration of the release element.

The embodiments illustrated in FIGS. 2 and 3 show the release element 1 in the region of the plug 4 as provided with an upper reinforcement part 4*a*. This part 4*a* can be dispensed with, as illustrated in FIG. 4, such that a continuous planar surface 29 is generated. In order to transfer pressure forces in the plug 4 only in the plug's outer region, the counter piece 15 is provided in its center part with a center recess 30.

Figure 5:
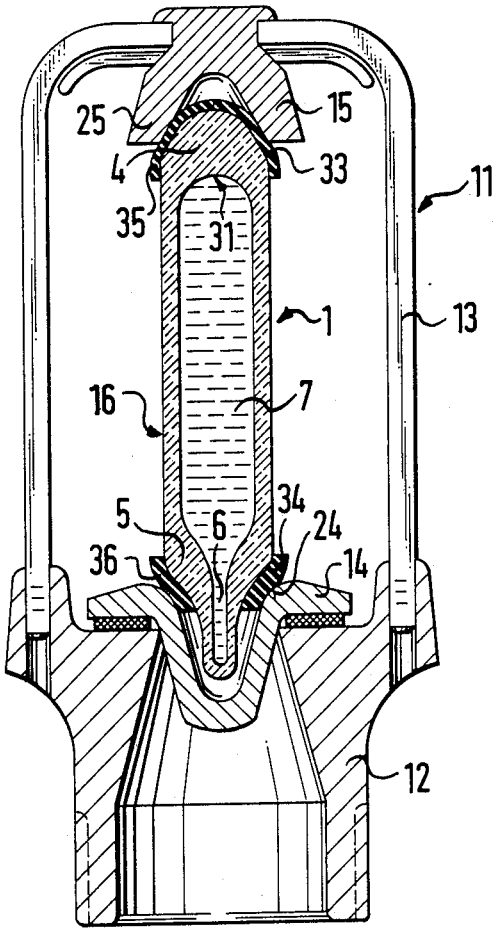
FIG. 5 is a cross-sectional view of a sprinkler with a further release element.
Figure 6:
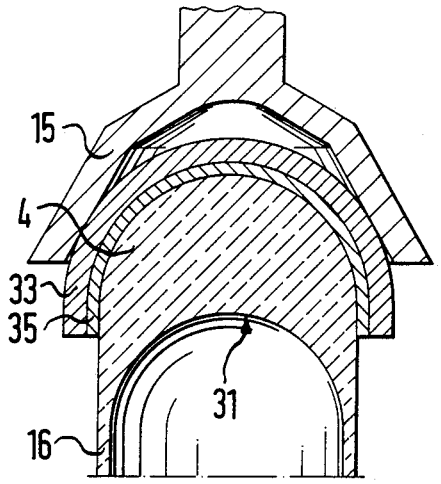
FIG. 6 is a sectional view, on an enlarged scale, of the release element with cap and counter piece.
Figure 7:
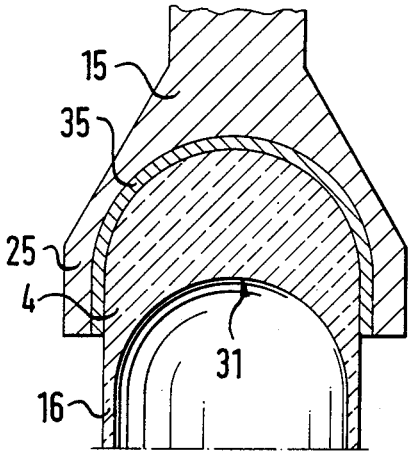
FIG. 7 is a sectional view, on an enlarged scale, of the release element with counter piece as cap.

In order for the closure forces acting on the release element 1 for exerting axial pressure forces onto the center cylindrical tube piece 16, the plugs 4 and 5 are respectively provided with a tension element which solidly spans around the plugs 4 and 5, as illustrated in FIG. 5. These tensions elements can be provided as closed cap 33 or as a cap ring 34, which are connected solidly to the plugs 4, 5 with a plastic or elastic mass 35, 36. A cap member can be a cap or a cap ring. The cap and cap ring are provided from aluminum, brass, or the like for reasons of preventing corrosion. It is part of the invention, for reasons of substitution, that the closure piece 14 and/or the counter piece 15 can be formed as a tension element and thereby the closure piece 14 and/or the counter piece 15 surround the release element 1 solidly with a collar 25, 26 extended up to the region of the cylindrical tube piece 16. Here again, there is respectively provided an elastic mass 35, 36 between the release element 1 and the parts 14, 15.

Figure 8:
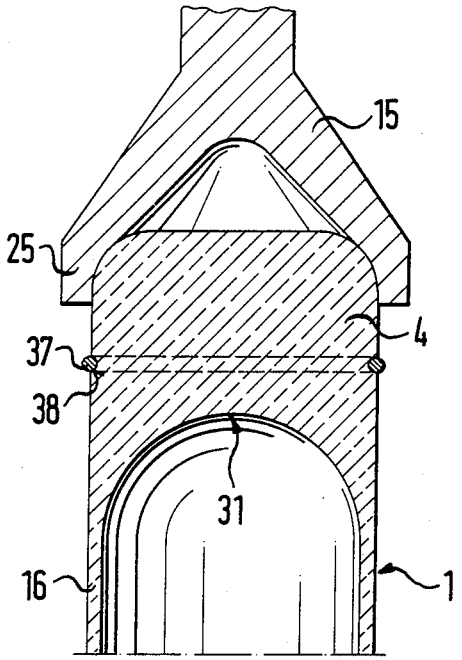
FIG. 8 is a sectional view of the release element with tension band as tension element.

FIG. 8 illustrates a tension element formed as a tension band 37, which is solidly tensioned as an O-ring in a groove 38 of the plug 4, 5. This tension band 37 can accept shearing forces such that the thin cylindrical tube piece 16 remains free of bending and shearing tensions.

The filler opening 6 can have a diameter which is from about 0.2 to 0.6 of the thickness of the wall of the glass tube 2. The thickness of the plug 4 or 5 can be from about 2 to 6 times the thickness of the tube wall and is preferably from about 3 to 5 times the thickness of the tube wall. The thickness of the tube wall can be from 1/10 to about ¼ of the inner diameter of the pipe. The plugs 4 can be formed on their inner side substantially spherical and on their outer side in a funnel shape. The cone angle at the tip of the cone can be from about 50 to 90 degrees and is preferably from about 60 to 70 degrees. The planar face 24 can be of annular shape, where the width of the annular part is from about 1/15 to ⅓ of the outer diameter of the tube. The planar face 23 can be formed as an annular ring having a width of from 1/10 to 1/5 of the outer diameter of the tube. The elastic mass 35, 36 can have a thickness from about 0.5 to the wall thickness of the glass tube.

It will be understood that each of the elements described above, or two or more together, may also find a useful application in other types of release elements differing from the types described above.

While the invention has been illustrated and described as embodied in the context of a release element for the thermal and/or electrical release of a fire-protection system, such as a sprinkler system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A release element according to claim 7, formed from glass for release of a fire-protection system, in particular a sprinkler system, comprising a cylindrical glass tube with a thin wall thickness;

an upper glass plug closing the cylindrical glass tube at its upper end; a lower glass plug disposed and attached at the lower end of the cylindrical glass tube;

a filler opening disposed in the lower glass plug;

bursting liquid filled into the lower glass plug to provide bursting of the release element with said liquid under specified conditions and where the filler opening is hermetically closed by melting in its lower part after the filling in of the bursting liquid;

a tension element;

wherein one of the plugs is provided on the outer side with the tension element, which tension element solidly spans around the plug; and wherein the tension element is formed as a circular tension band which is solidly clamped under tension in a groove of the plug.

2. The release element according to claim 1, wherein the upper glass plug and the lower glass plug are tapered in axial direction.

3. The release element according to claim 1, further comprising a closure piece;

a sprinkler;

a counter piece in the sprinkler, wherein the release element is pressed against the closure piece by the counter piece in the sprinkler.

4. The release element according to claim 3, wherein the sprinkler is provided with a sprinkler casing and with a sprinkler bow, wherein the upper glass plug and the lower glass plug are respectively provided with a planar face running respectively at a right angle relative to a center axis of the glass tube, wherein the lower planar face rests at a planar face of the closure piece of the sprinkler casing, and wherein the upper planar face rests at a planar face of the counter piece of the sprinkler bow.

5. The release element according to claim 4, wherein the closure piece and the counter piece are respectively provided with a collar, wherein the inner faces of the collar run parallel to the center axis of the glass tube, and wherein the outer faces of the respective plugs rest planarly at the collar inner faces.

6. The release element according to claim 5, wherein a curvature is provided respectively between the outer faces and the planar faces of the release element.

7. The release element according to claim 1, wherein the tension element is formed as a closed cap member, which cap member is led into the region of the cylindrical tube.

8. The release element according to claim 7, wherein the cap member is solidly connected with an elastic mass to a respective plug.

9. The release element according to claim 8, wherein the fire protection system is electrically released and wherein a sprinkler system is thermally released and wherein the cap member is made of a non-iron metal, such as aluminum, brass, or the like.

10. The release element according to claim 1, wherein the counter piece and/or the closure piece are formed as tension elements and where the counter piece and/or the closure piece respectively solidly surround the release element with a collar.

11. The release element according to claim 10, wherein the collars are extended up to the region of the cylindrical tube.

12. The release element according to claim 10, wherein the plugs are covered on their outer face with an elastic mass and can rest on the elastic mass.

13. The release element according to claim 1, wherein the tension band is formed by an O-ring.

14. The release element according to claim 13, wherein the O-ring is comprised of a copper wire.

15. The release element according to claim 1, wherein the inner space of the release element exhibits at the upper end a semi-spherical shape and at the lower end a funnel shape.

16. A release element for thermal and/or electrical release of a fire-protection system, in particular a sprinkler system, where the release element formed from glass is filled to its bursting with a liquid, wherein the release element (1) comprises a cylindrical glass tube (2) with a thin wall thickness (3), which is closed at its upper end by means of a glass plug (4) and which is provided at its lower end with a plug (5) and a filler opening (6), which is hermetically closed by melting in its lower part (8) after the filling of the bursting liquid into the inner chamber (7), wherein the plugs (4, 5) are respectively provided on the outer side with a tension element which solidly span around the plugs;

wherein the counter piece (15) and/or the closure piece (14) are formed as tension elements and where the counter piece (15) and/or the closure piece (14) respectively solidly surround the release element (1) with a collar (25);

wherein the collars (25, 26) are extended up to the region of the cylindrical tube projection (10);

wherein the plugs (4, 5) are covered on their outer face with an elastic mass (35, 36), and where the pieces (4, 5) rest on the elastic mass (35, 36);

wherein the tension element is formed as a circular tension band (37) which is solidly clamped under tension in a groove (38) of the plug (4, 5);

wherein the tension band (37) is formed by an O-ring;

wherein the O-ring is comprised of a copper wire;

wherein the inner space (7) of the release element (1) exhibits at the upper end a semi-spherical shape (31) and at the lower end a funnel shape (32).

* * * * *